United States Patent [19]

Brown

[11] Patent Number: 4,501,194

[45] Date of Patent: Feb. 26, 1985

[54] WHOLE HOUSE ATTIC FAN

[75] Inventor: William J. Brown, St. Louis County, Mo.

[73] Assignee: Emerson Electric Co., St. Louis, Mo.

[21] Appl. No.: 507,041

[22] Filed: Jun. 23, 1983

[51] Int. Cl.[3] ..... F24F 7/06

[52] U.S. Cl. ..... 98/42.07; 98/116

[58] Field of Search ..... 98/43 R, 116, 118; 285/158, 191, 195

[56] References Cited

U.S. PATENT DOCUMENTS

| | | | |
|---|---|---|---|
| 369,200 | 8/1887 | Merz | 285/158 X |
| 1,693,396 | 11/1928 | Littleton . | |
| 2,278,581 | 4/1942 | Dexter | 98/43 |
| 2,673,514 | 3/1954 | Hanks | 98/116 |
| 2,875,678 | 3/1959 | Shepherd | 98/43 |
| 2,911,900 | 11/1959 | Rudy | 98/116 |
| 3,149,553 | 9/1964 | Solzman | 98/43 |
| 3,895,568 | 7/1975 | Stone | 98/43 |
| 4,123,968 | 11/1978 | Malott | 98/43 |
| 4,261,255 | 4/1981 | Anderson et al. | 98/42 |
| 4,271,751 | 6/1981 | Timmons | 98/40 |
| 4,336,749 | 6/1982 | Barnhart et al. | 98/116 X |
| 4,385,550 | 5/1983 | Steiner et al. | 98/43 R |
| 4,406,216 | 9/1983 | Hott et al. | 98/43 R X |

FOREIGN PATENT DOCUMENTS 819012 8/1959 United Kingdom .

*Primary Examiner*—Harold Joyce

*Attorney, Agent, or Firm*—Polster, Polster and Lucchesi

[57] ABSTRACT

A whole house attic ventilating fan is disclosed which is installable within an opening in the ceiling of the house from below. A plenum box is installable against the attic-side of the ceiling sheathing in register with the opening with the plenum box having a venturi opening therein. A venturi is secured to the top of the plenum box and a fan motor and fan assembly is mounted within the venturi, the fan assembly being secured to a pair of joists by means of arms extending outwardly through openings in the venturi. The plenum box may fit between adjacent joists or may accommodate one or more joists if these joists extend across the opening in the ceiling. A method of installing the fan within the ceiling from below without the necessity of access to the attic crawl space is also disclosed.

12 Claims, 7 Drawing Figures

FIG.6.
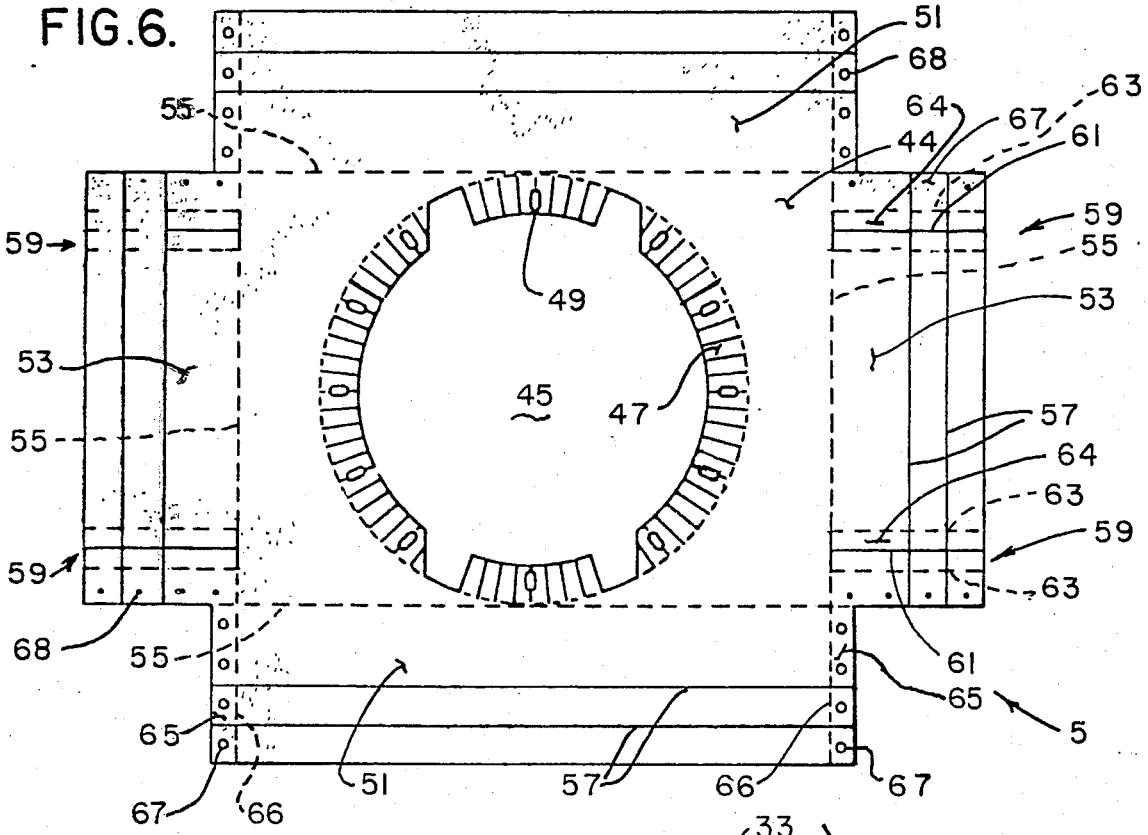
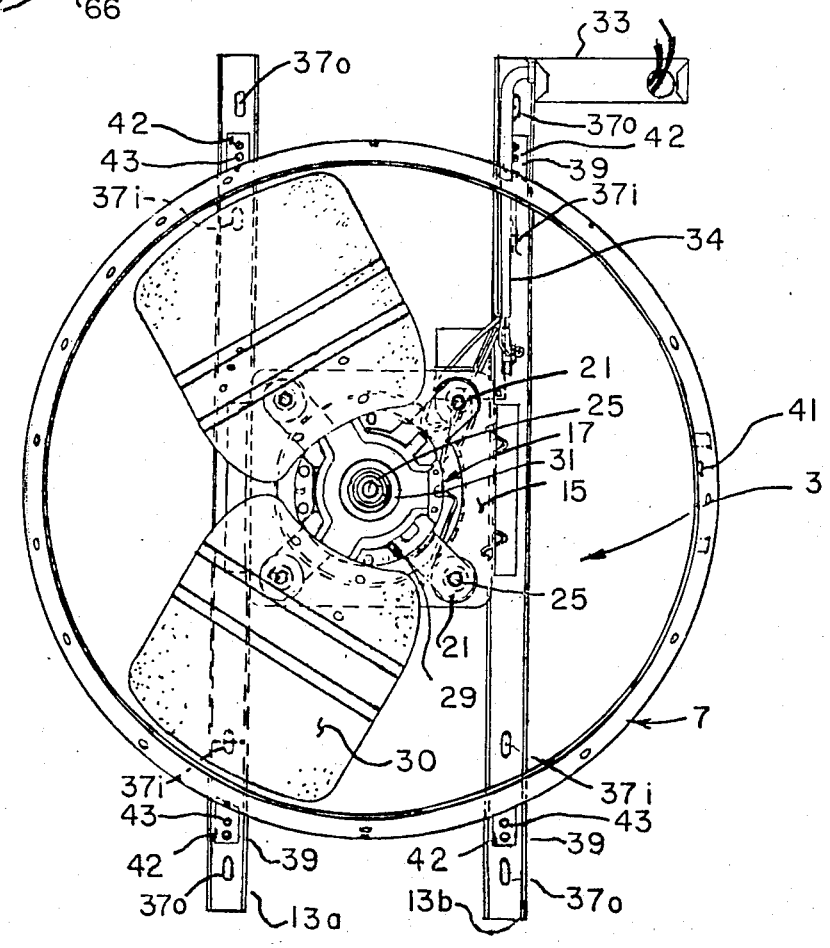
FIG.7.

WHOLE HOUSE ATTIC FAN

BACKGROUND OF THE INVENTION

This invention relates to a whole house attic ventilating fan, and more particularly to such an attic ventilating fan and to a method of installing the fan in which the fan is installable from below in an opening cut in the ceiling sheathing of the house such that access to the attic crawl space is not required for installation of the fan when the fan is installed in a ceiling housing its joists on a common on-center spacing (e.g., 24 inches).

In general, whole house ventilating fans are utilized to draw cooler outside air into the living space of a house through open windows or doors, to force the air into the attic space of the house, and to exhaust air from the attic space to the outside via attic vents or the like. In the summer, such whole house ventilating fans result in cooler, outside air being circulated through the house such that the moving air feels significantly cooler to the occupants of the house. Further, by forcing outside air into the attic space and by thus displacing air from within the attic space to the outside via proper attic vents, the temperature of the air within the attic space can be significantly lowered on hot days. It will be appreciated that extreme air temperatures (e.g., 140° F. or more) may be present in an attic which is not power ventilated. This heated air within the attic will heat the ceiling of the house, even though the ceiling may be well insulated. In well insulated houses, the highest temperature of the ceiling may not be attained for several hours past the heat of the day due to the thermal lag of the insulated ceiling. Thus, in the evening, when the ceiling reaches its highest temperature, the heated ceiling will radiantly heat the occupants of the house making it feel significantly warmer within the house than the ambient air temperature within the house.

Whole house ventilating fans have long been used to economically and efficiently circulate air through the living space of the house and to exhaust heated air from the attic space. Typically, whole house ventilating fans may be mounted vertically in an attic gable wall, in the roof, or horizontally in the ceiling of the house. The present invention is most particularly concerned with the horizontal mounting of whole house ventilating fans in an opening provided in the ceiling of the house with this opening in the ceiling providing communication between the living space of the house and the attic space. With such an installation, it is generally desirable to locate the fan centrally within the house so that air may be uniformly drawn from all parts of the living space of the house toward the fan, depending on which windows or doors of the house are open. For example, in a one story house, the fan may be located in a central hallway ceiling leading from the living areas of the house to the bedrooms.

In many prior whole house ceiling ventilating fans, it was necessary to first determine the best location for the fan and to cut a rectangular opening of predetermined size in the ceiling sheathing (e.g., the drywall) of the house. Since these whole house ventilating fans are usually of a relatively large size (e.g., the fan blades may have a diameter of 36 inches (91.4 cm.) or larger), the fan opening in the ceiling was, of necessity, relatively large such that one or more of the ceiling joists of the house would extend across the ceiling opening. Ceiling joists may, for example, be the bottom chords of prefabricated roof trusses. In many types of home construction, the ceiling sheathing is nailed to the bottom faces of the roof truss bottom chords or roof joists. These ceiling joists may be placed at uniform distances relative to one another, typically on 16 inch (40.6 cm.) or 24 inch (61 cm.) centers, and are usually of 2×4, 2×6, 2×8, or 2×10 lumber, depending on the size of the house and the design of the roof. These joists would be cut and header plates (i.e., lumber of the same dimensions as the joists) would be nailed in place transversely between the uncut joists and to the ends of the cut joists so that the inner sides of adjacent uncut joists and the header plates form a plenum box slightly above the level of the ceiling sheathing. The fan would then be mounted on top of the joists, and plenum box and a venturi would often be provided so as to at least partially enclose the fan blades thereby to enhance the operating efficiency of the fan.

As can be appreciated, it is a major carpentry task, sometimes too involved for the "do-it-yourself" installer, to cut the ceiling joists and to nail the header plates in place. Also, by cutting the joists, the strength of the roof or the ceiling of the house could be unduly weakened. It will be appreciated that the joists, since they oftentimes constitute the lower chords of the roof trusses, carry a significant load, often a tension load, when the roof is heavily stressed, such as during a windstorm or when it carries a significant snow load.

In an effort to eliminate the necessity of having to cut the joists and having to install headplates, a fan was commercially introduced, as disclosed in the coassigned U.S. Pat. No. 4,325,550, which included a frame mountable on the tops of adjacent ceiling joists. A venturi carried by the fan frame defined a venturi throat and skirts were provided which depended downwardly from the venturi so as to sealingly mate with the upper surfaces of the ceiling sheathing thereby to form a plenum box with the skirts having prescored slots or other means therein so as to accommodate (i.e., to fit over) the ceiling joists extending across the ceiling opening. While this fan greatly facilitated installation because it eliminated the necessity of having to cut the ceiling joists and to install header plates, it was necessary for the installer to have access to the attic crawl space from above for installation of the fan. It will be appreciated that in many applications, only a limited crawl space (sometimes 2 feet or less) is available between the tops of the ceiling joists and the roof of the house making access to the fan from above difficult. Thus, there has been a longstanding need for a whole house fan which can be readily installed from below within the attic of the house in register with an opening in the ceiling sheathing without the necessity of having access to the attic crawlspace.

SUMMARY OF THE INVENTION

Among the several objects and features of the present invention may be noted the provision of a whole house ventilating fan, such as above described, and a method of installing the fan within the attic space of a house in register with an opening in the ceiling sheathing from below (i.e., from the living space) via the ceiling opening without the necessity of access to the attic space;

The provision of such a whole house ventilating fan which may be installed in the ceiling without the necessity of cutting any ceiling joists;

The provision of such a whole house ventilating fan in which the plenum box and the venturi for the fan may be readily, sealably secured together from below;

The provision of such a whole house ventilating fan which may be readily adapted for securement to neighboring ceiling joists whether the spacing between the centers of the ceiling joists be either 16 inches or 24 inches; and The provision of such a ceiling fan which is easy to install, which is light in weight enabling it to be readily lifted through the opening in the ceiling from below, which is quiet and efficient in operation, and which is readily adaptable to a wide range of ceiling constructions.

Briefly stated, a ventilating fan of the present invention is installable in the ceiling of a house for drawing air from outside of the house through the living areas of the house, for forcing the air into the attic space of the house, and for exhausting air from within the attic space to the outside via attic vents or the like. As is typical, the house has a ceiling comprising a plurality of horizontal joists parallel to one another and spaced from one another at substantially uniform intervals. Ceiling sheathing is secured to the bottom faces of the joists. An opening in the ceiling sheathing is provided. The fan includes an electric induction motor and a rotary fan blade assembly driven by the motor. More specifically, the improvement of this invention comprises a frame for mounting the motor and the fan blade on top of the ceiling joists with the fan blade being in communication with the ceiling opening. The frame comprises a plurality of legs secured to the motor and fan assembly with each of the legs having means on its outer end engagable with the upper face of a respective ceiling joist thereby to securely mount the motor and fan assembly on a pair of ceiling joists. A venturi is provided which surrounds the fan blade, the venturi being of somewhat larger cross section than the diameter of the fan blade and being supported by the previously mentioned frame legs. A plenum box having a top cover and sides depending downwardly therefrom is adapted to be in substantial sealing engagement with the ceiling sheathing the adjacent ceiling opening, the plenum box having a top cover with an opening therein for registration with the venturi. The venturi is disposed on the top of the top cover of the plenum box generally in register with the top cover opening and the top cover opening has means for securing the venturi to the top cover wherein access to the interior of the venturi is required only to the inside thereof for securement of the venturi to the plenum box.

Other objects and features of this invention will be in part apparent and in part pointed out hereinafter.

BRIEF DESCRIPTION OF THE DRAWINGS

FIG. 6 is a flat pattern layout of the plenum box; and

FIG. 7 is a top plan view of the motor/fan assembly with the truncated conical venturi installed thereon.

Corresponding reference characters indicate corresponding parts throughout the several views of the drawings.

DESCRIPTION OF A PREFERRED EMBODIMENT

Figure 1:
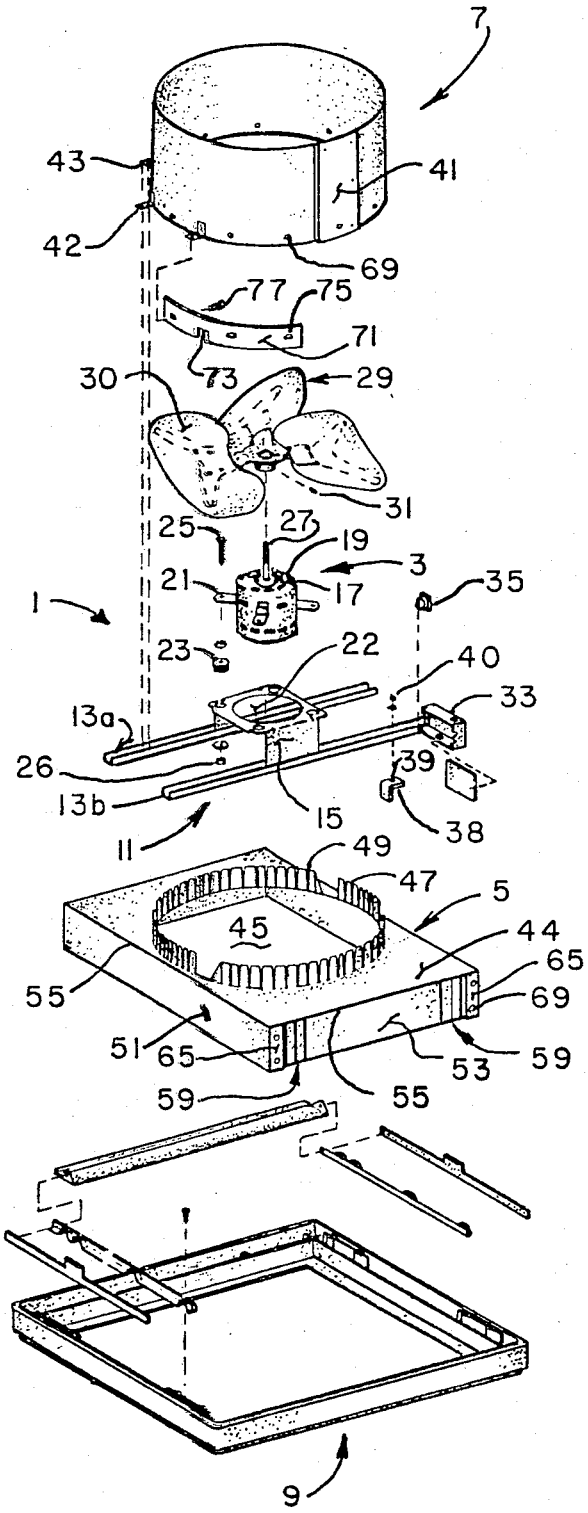
FIG. 1 is an exploded perspective view of whole house, ceiling ventilated fan of the present invention together with an optional shutter system.

Referring now to the drawings, a whole house ventilating fan of the present invention is indicated by reference character 1. As shown in FIGS. 2–5, fan 1 of the present invention is intended to be installed in an opening O in the ceiling C of a residential building or home so as to draw outside air into the living space of the house through open windows or doors, to force air into the attic space of the house above ceiling C, and to exhaust air from within the attic space to the outside via appropriate attic vents or openings (not shown). In this manner, cooler outside air can be continuously drawn into the living quarters of the house thus reducing the air temperature in the house and providing air movement which in turn enhances the comfort index within the house.

Further, by displacing the heated air from within the attic space of the house and by replacing it with cooler air, the air temperature within the attic space may be dramatically reduced (e.g., from 140° F. to 90° F.). If the fan operates continuously, the reduction of the air temperature within the attic space of the house will prevent the attic insulation and ceiling structure of the house from absorbing a significant amount of heat which, particularly in the evening hours, radiates downwardly into the living quarters of the house making the occupants feel uncomfortable, even when the air temperature and humidity within the house is at a comfortable level. By utilizing a whole house ventilating fan such as above described, the house can be maintained at a comfortable level without the necessity of air conditioning, all but for the few hottest days of the year. Also, in many instances, the air conditioner may be shut off during the majority of the day and need only be turned on to cool the house in the late afternoon and early evening hours. Since attic fans draw only a fraction of the electrical power required to operate central air conditioning units for the same size house, considerable energy savings can be realized by the homeowner.

Figure 2:
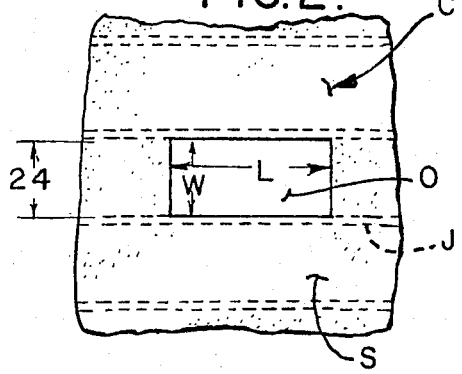
FIG. 2 is a bottom plan view of a portion of a ceiling in which the whole house fan of the present invention is to be installed with the ceiling joists (shown in dotted lines) being spaced on 24 inch centers.
Figure 3:
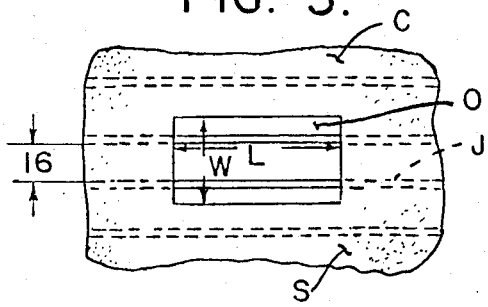
FIG. 3 is a view similar to FIG. 2, but with the ceiling joists spaced on 16 inch centers.

Generally, the first step in installing the ventilating fan 1 of the present invention is to select the desired location for mounting the fan within the house. Usually, this location is chosen to be a center hallway such that the fan may uniformly draw air from the bedrooms or from the living areas of the house, depending on which doors or windows of the house are open. The joists may run perpendicularly (i.e., crossways) to the hallway in which case the hallway should have a minimum width (e.g., approximately 32 inches for one size of the fan of the present invention) such that an opening O having a maximum length L of 29.5 inches (75 cm.) and a width W of 22.5 inches (57 cm.) can be formed in the ceiling sheathing S centered within the hallway with about one and one-half inches (3.8 cm.) of clearance on each side of the opening. In other installations, ceiling joists J may run parallel to the hallway in which case the minimum required width for the hallway is approximately 29 inches (73.7 cm.) if the same size opening is utilized. In either event, once the location for the fan 1 has been chosen, it is generally preferable to determine whether the spacing of the joists is on 16 inch, or more commonly, on 24 inch centers. If the joists are on 24 inch centers, the opening O should be cut in ceiling sheathing S relative to a pair of adjacent joists J generally as illustrated in FIG. 2. If, on the other hand, ceiling joists J are on 16 inch centers, opening O should be cut in the ceiling sheathing S in the manner illustrated in FIG. 3. As shown in FIG. 2, it will be noted that the width of opening O is approximately the same distance as the inner faces of adjacent joists J are spaced apart when the joists are on 24 inch centers. In FIG. 3, it will be noted that the width of opening O is greater than the spacing of a pair of adjacent joists J such that at least one (usually two) of the joists extend across opening O. After opening O has been cut in the ceiling, a power supply line (not shown) for the fan may be run through the attic space of the house from a proper power supply in accordance with local building codes to the location where fan 1 of the present invention is to be installed. It will be appreciated that opening O can be utilized to aid in the running of the power line.

Referring now to FIG. 1, a more detailed description of the construction of the whole house ceiling ventilating fan 1 of the present invention will be provided. More specifically, fan 1 includes a fan/motor assembly, as generally indicated at 3. Additionally, a so-called plenum box, as generally indicated at 5, is provided which is a one-piece member formed of a suitable material, such as fibreboard having a polyethylene liner on both sides so as to protect the fibreboard from moisture. In addition, a truncated, conical venturi, as generally indicated at 7, is secured to plenum box 5, and, as is best shown in FIG. 7, and the fan motor assembly 3 is mounted within venturi 7. An optional pressure actuated shutter assembly 9 may be provided which is mounted to the bottom face of ceiling sheathing S so as to cover opening O in ceiling C. It will be understood that the shutter assembly 9 includes a plurality of shutters 10 which open automatically upon energization of the fan so as to permit air to flow to the fan through opening O. Upon de-energization of the fan, springs (not shown) included within shutter assembly 9 will automatically close the shutters thereby to prevent the exchange of air between the living space and the attic space of the house. The shutter assembly 9, as described above, is conventional and is well-known to those skilled in the whole house ventilating fan field and as such does not, per se, constitute an integral part of the present invention. Therefore, a detailed description of the shutter assembly 9 will not be provided.

The fan/motor assembly 3 is shown to comprise a frame, as generally indicated at 11, having a pair of spaced, channel-shaped frame members or arms 13*a*, 13*b*. These frame members 13*a*, 13*b* have a length somewhat greater than the greatest anticipated common spacing of joists J in ceiling C. For example, if the greatest anticipated spacing of joist J would be on 24 inch centers, these frame members 13*a*, 13*b* may have an overall length of about 27 inches (68.6 cm.). Frame 11 further includes a motor support bracket 15 which joins frame members 13*a* and 13*b* generally at the center thereof. An induction electric motor, such as a permanent split capacitor motor, is indicated in its entirety by reference character 17. Motor 17 is shown to comprise an outer housing or shell 19 which has a plurality (e.g., four) of mounting brackets 21 extending generally radially outwardly from shell 19. Motor support 15 has a central opening 22 therewithin for receiving the lower portion of shell 19 of motor 17 and has four apertures at the corners of the motor support generally in register with bolt holes provided in brackets 21. As indicated at 23, elastomeric grommets are interposed between the upper face of motor support 15 and the lower face of each of the brackets 21 and a suitable motor mounting bolt 25 is inserted through the apertures in motor mounting brackets 21, through the elastomeric grommets 23, and through the motor mounting apertures in motor support 15 such that when a nut 26 is installed on the mounting bolt and tightened, motor 17 is positively, resiliently mounted on motor support 15 in a cushioned fashion on grommet 23 thereby to minimize noise transmission and vibration.

Motor 17 further has a rotor shaft 27 extending upwardly beyond its upper end and a fan blade assembly, as generally indicated at 29, is mounted on rotor shaft 27. The fan assembly is shown to include three inclined fan blades 30 secured to a central hub which in turn receives rotor shaft 27. The fan assembly 29 is positively locked to the rotor shaft by means of a set screw 31 insertable into the fan assembly hub and engagable with the rotor shaft.

As indicated at 33, a switch box is mounted on one of the frame channel members (e.g., member 13*b*) at one end thereof such that the lead wires from motor 17 may be routed along this channel member to the switch box in a lead wire sleeve or conduit 34, as best shown in FIG. 7. A chain pull switch, as indicated at 35, is mounted within switch housing 33 and the pull chain for the switch 35 may be dropped downwardly through an appropriate hole (not shown) in ceiling sheathing S thereby to permit the occupants of the house in which fan 1 is to be installed to readily control energization and de-energization of the fan. Alternatively, fan motor 17 may be wired in a conventional manner to a wall switch so as to control operation of the fan.

Referring to FIG. 7, each of the frame channels 13*a*, 13*b* is provided with an inner and outer slot in its web, as indicated at 37*i*, 37*o*, respectively, such that when the frame channels are positioned on top of a pair of adjacent joists J, either the inner slots 37*i* or the outer slots 37*o* will be generally in register with the top faces of a pair of joists J, regardless of whether the joists are spaced on 24 inch centers (as shown in FIG. 2) or on 16 inch centers (as shown in FIG. 3). As shown in FIG. 1, angle-shaped mounting brackets 38 having a threaded stud 39 extending therefrom are adapted to be secured to the frame channel members 13*a*, 13*b* such that the stud 39 secured to each bracket 38 extends through a respective inner or outer slot 37*i*, 37*o* in the channel members. Then, a nut 40 is threaded onto stud 39 thereby to positively secure motor frame 11. The brackets 38, when secured to frame members 13*a*, 13*a* via slots 37*i*, 37*o*, are adapted to mate with a pair of adjacent joists J. Further, brackets 38 are angle-shaped and the vertical legs thereof may be nailed to the joists from below, as indicated at N, so as to positively secure motor/fan assembly 3 to the upper faces of a pair of neighboring joists J with the fan/motor assembly 3 substantially centered within opening O cut in ceiling C regardless of whether the joists J are on 24 inch or 16 inch centers. A rubber cushion RC is attached to each of the brackets 38 between the brackets and the joists so as to damp vibrations and noise.

As previously described, venturi 7 is a truncated cone preferably made of a polyethylene lined fibreboard similar to plenum box 5. As shown in FIG. 1, the conical venturi 7 is a one-piece member rolled into conical form with its free ends joined together by a splicing plate 41. At opposite diametric sides of venturi 7, four brackets, as indicated at 42, are secured to the sidewalls of the venturi body so as to be in register with the open faces of channel frame members 13*a*, 13*b* and so as to be in register with screw openings provided in the channel frame members. Then, suitable screws, as indicated at 43, may be inserted through brackets 42 and threadably engaged with screw openings in the webs of the channel frame members 13*a*, 13*b* so as to positively secure the venturi to frame 11 such that the fan/motor assembly 3, frame 11, and venturi 7 may be installed in the ceiling as a unit, as will be hereinafter more fully explained.

Referring now to FIGS. 1 and 6, plenum box 5 is preferably a one-piece member formed of a suitable polyethylene lined fibreboard material die cut and prescored generally into a flat pattern, as illustrated in FIG. 6. The flat pattern for plenum box 5 includes a central or top cover portion, as indicated at 44, with a central venturi opening 45 provided therein. A plurality of fingers, each of which is indicated at 47, extends generally radially inwardly of opening 45 and each of the fingers is scored at its base end relative to top cover 44 such that the fingers may be bent out of the plane of top cover 44 at an angle generally perpendicular to the plane of the top cover such that the fingers 47 will be engagable with the inner face of conical venturi 7 in a manner as will be more fully explained hereinafter so as to aid in the securement of the venturi to the plenum box. Additionally, a number of openings or apertures 49 are provided in certain of the fingers 47 for the reception of fasteners which secure venturi 7 to the plenum box.

Referring now to FIG. 6 and the flat pattern of plenum box 5, it will be appreciated that the plenum box is sized so that when it is folded into its box-shaped configuration, as shown in FIG. 1, the major sides of the plenum box will fit snugly between the inner faces of adjacent joists J when the joists are on 24 inch centers and it will extend generally from the bottom faces of the joists to the top faces of the joists, regardless of the depth of the joists. More specifically, the flat pattern for plenum box 5 has a pair of major flaps, as indicated at 51, integral with top cover 44 extending out from the major opposite sides thereof and a pair of minor flaps, as indicated at 53, extending out from the opposite minor sides of top cover 44. A fold line, as indicated at 55, is preformed in the flat pattern so that the major and minor flaps may be folded downwardly from their flat pattern position so as to form the major and minor sidewalls of the plenum box, as illustrated in FIG. 1. Each of the major and minor flaps has a height from its respective foldline 55 to its outer or bottom edge sufficient to sealingly bear on the upper face of the ceiling sheathing S (or to be generally coplanar with the bottom face of the ceiling joists J) and to extend up to (or somewhat above) the level of the top surfaces of the ceiling joists when 2×8 lumber is used for the joists. Additionally, as indicated at 57, cut-off lines are imprinted on the major and minor flaps such that excess length of the flaps may be cut away prior to assembly of the plenum box if 2×6 or 2×4 lumber is utilized for ceiling joists J.

Figure 4:
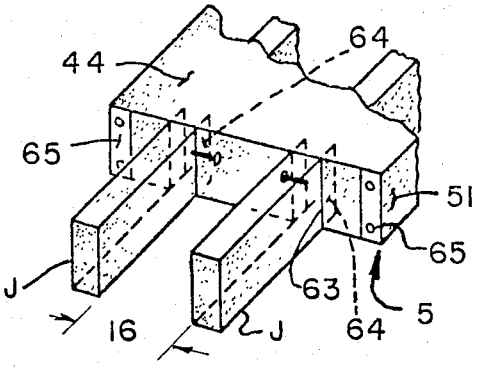
FIG. 4 is a bottom plan view of two neighboring ceiling joists spaced on 16 inch centers with the plenum box of the fan of the present invention formed to accommodate the joists and secured thereto.

If fan assembly 1 is to be installed in a ceiling C having joists J on 24 inch centers, plenum box 5, when assembled, is so sized as to fit between the inner faces of the adjacent joists J and to be nailed through the major flaps 51 in place relative to the joists. However, in the event the ceiling fan 1 of the present invention is to be installed in a ceiling in which the joists J are on 16 inch centers, means, as indicated at 59, is provided in the minor end flaps 53 of plenum box 5 for accommodating one or more, preferably a pair of, joists J which extend across opening O in such manner that the joists need not be cut for installation of the fan. More specifically, this joist accommodating means 59 is shown to comprise a slit (or a pair of spaced slits) 61 which extends from the bottom edge of the minor flaps 53 to fold line 55. Additionally, fold lines 63 are provided on the minor flaps on either side of slits 61 so as to define joist flaps 64. The minor flaps are further slit along fold line 55 in the area between a pair of adjacent flap fold lines 63 such that joist flaps 64 may be bent inwardly toward the center of the plenum box 5 (as shown in FIG. 4) such that the minor flaps 53 of the plenum box 5 may be placed down over a pair of adjacent joists J whereby the joists are accommodated by the folded out flaps 64 in the manner generally shown in FIG. 4 thereby to accommodate the pair of joists which extend across opening O, as shown in FIG. 3. As shown in FIG. 4, nails may be driven through the inwardly folded joist flaps 64 into the joists J so as to securely hold the plenum box 5 in place on the joists.

Further, plenum box 5 has a securement flap 65 provided at the outer end of each of its major flaps 51 with each of these securement flaps being adapted to be folded inwardly along a fold line 66 for being disposed on the outside of the outer edges of the minor flaps when the major and minor flaps are bent downwardly along their respective fold lines 55 so as to form the major and minor sides of the plenum box. Flap 65 includes a plurality of apertures 67 which are in register with respective apertures 68 provided in the outer edge portions of the minor flaps such that push through fasteners 69, as shown in FIG. 1, may be inserted through aperture 67 and 68 thereby to positively lock the sides of the major and minor flaps 51 and 55 of the plenum box together in the manner shown in FIG. 1.

In installing of fan 1 of the present invention, after opening O has been cut in ceiling sheathing S, either as illustrated in FIG. 2 or in FIG. 3, the fan/motor assembly together with venturi 7 and brackets 38 secured to frame members 13*a*, 13*b* (as described above) is turned sidewise and is lifted up through opening O into the attic space and is set off to one side adjacent opening O. It will be appreciated that the overall length of the venturi 7 and the fan motor assembly 3 installed on frame 11 is preferably less than the spacing between the adjacent joists J spaced on 16 inch centers. With the fan so lifted in place into the attic space, electrical connections from the power leads to switch box 33 may be readily made with the installer having access to the fan and the power line through opening O in the ceiling.

For installations in ceiling C, such as illustrated in FIG. 2 wherein joists J are spaced 24 inches on centers, the fan/motor assembly 3 is inserted up through opening O, as previously described, and is turned 90° so as to allow mounting brackets 38 previously secured to frame members 13*a*, 13*b* via slots 37*o*, to mate with the joists J.

The brackets are rotated about studs 39 such that the vertical legs of the brackets with the nail holes N therein are visible from the insides of the pair of mounting joists and such that the previously-mentioned elastomeric pads (not shown) bear on the joists. Then, the fan assembly 3 is centered between the joists in widthwise and lengthwise direction. Mounting brackets 38 are then nailed in position on the studs by nails N so as to positively secure the fan/motor assembly 3 to the joists J. At this point, wiring connections to switch box 33 may be made and the pull chain for switch 35 may be dropped down through an opening (not shown) made in ceiling sheathing S proximate the location of the pull switch within switch box 33.

With plenum box assembled and trimmed to its desired depth, generally as shown in FIG. 1, the plenum box is inserted upwardly through opening O of FIG. 2 with the major flaps 51 of the plenum box positioned on the inside faces of the adjacent joists J supporting the motor/fan assembly 3 and the plenum box is positioned relative to the joists such that the venturi opening 45 of the plenum box is substantially centered relative to the fan and such that the bottom portion of the plenum box is generally proximate the lower faces of the joists J. Then, the plenum box 5 is nailed to joist J at approximately four locations along each side so as to secure the plenum box in position between the joists.

The plenum box is sealingly connected to venturi 7 from below by bending fingers 47 upwardly so that they extend generally perpendicularly outwardly from the top cover 44 of the plenum box and such that the fingers 47 are disposed against the inner, bottom face of the truncated conical venturi 7. A plurality of securement bands 71 (for example, four such bands may be provided) are then fitted to the inner faces of the upwardly bent fingers 47. These securement bands have notches 73 provided therein for receiving channel frame members 13*a* and 13*b* and for locating the securement bands relative to the venturi. Additionally, securement bands 71 have a plurality of apertures 75 therein which, when the bands are installed on the plenum box, are generally in register with openings 49 provided in fingers 47 of plenum box 5. With the securement bands 71, fingers 47, and venturi 7 assembled as above described, push-type fasteners 77 of suitable synthetic resin material or the like may be inserted through apertures 75 in band 71, through apertures 49 in fingers 47, and through holes 69 in the bottom portion of venturi 7 from below thereby to secure and to substantially seal plenum box 5 with respect to venturi 7. It will be further understood that the entire fan assembly, when installed on joists J spaced on 24 inch centers, may be thus installed within the ceiling C (or within the attic) entirely from below without access to the attic crawl space.

Figure 5:
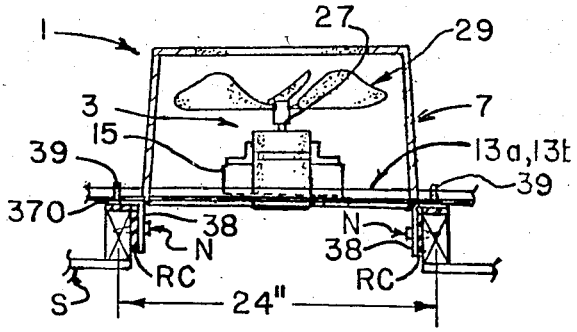
FIG. 5 is a semi-diagrammatic view of a portion of the whole house ventilating fan of the present invention (i.e., the motor/fan assembly and venturi) mounted on the top surfaces of two neighboring ceiling joists spaced on 16 inch centers with the fan centered with respect to the opening in the ceiling.

However, if the fan 1 of the present invention is to be installed in a ceiling C, such as shown in FIG. 3, in which joists J are spaced on 16 inch centers, a slightly different installation procedure is preferable. First, the motor/fan assembly 3 together with venturi 7 secured to frame 11 is turned sideways and is lifted up through the space between the adjacent joists J, as shown in FIG. 3, and is set off to one side of opening O resting on the top surfaces of other joists J comprising the ceiling. At this point, the electrical connections to switch box 33 may be made from below with access via opening O. The assembled plenum box 5, as generally shown in FIG. 1, trimmed for the corresponding depth of joists J is turned sideways and is lifted up through opening O to a level above the top surfaces of joists J and is rotated to a generally horizontal position such that joists receiving means 59 are generally in register with the pair of joists J extending across opening O. Further, the plenum box is centered relative to the opening O and flaps 64 are nailed to the joists J, as shown in FIG. 5.

Then, the installer reaches up through venturi opening 45 and grasps the fan/motor assembly 33 previously inserted into the attic space and moves the fan assembly over plenum box 5 until mounting brackets 38 secured to frame members 13*a*, 13*b* via inner slots 37*i* are positioned on the inside faces of the joists. The mounting brackets are then nailed to the joists by nails N.

At this point in time, the plenum box is sealingly secured to the venturi utilizing fingers 47, securement bands 71, and push fasteners 77 in the manner heretofore described. In either case, it may be advisable to seal the plenum box/venturi joint utilizing a suitable mastic tape, such as masking tape or duct tape (not shown). Also, regardless of the installation procedure followed, the shutter assembly 9 (as shown in FIG. 1) may be inserted on the bottom face of ceiling C generally in register with opening O from below.

In view of the above, it will be seen that the other objects of this invention are achieved and other advantageous results obtained.

As various changes could be made in the above constructions or method without departing from the scope of the invention, it is intended that all matter contained in the above description or shown in the accompanying drawing shall be interpreted as illustrative and not in a limiting sense.

What is claimed is:

1. In a ventilating fan installable in the ceiling of a building for drawing air from outside the building through the interior of the building, for forcing air into the attic space of the building, and for exhausting air from within the attic space of the building to the out of doors via attic vents or the like, the building having a ceiling comprising a plurality of joists parallel to one another and spaced from one another at substantially uniform intervals, the ceiling further comprising sheathing secured to the bottom faces of said joists, and an opening in said sheathing, said ventilating fan including an electric motor and a rotary fan blade driven by said motor, wherein the improvement comprises: a frame for mounting said motor and said fan blade on top of a pair of said joists with said fan blade being in communication with said opening, said frame comprising a plurality of arms secured to said motor, each of said arms having means engagable with a respective joist for securely mounting said frame to said joists, a generally truncated conical venturi surrounding said fan blade, said venturi being of somewhat larger cross section than the diameter of said fan blade and being of a height similar to or greater than said motor and fan blade, a plenum box having a top cover and sides depending downwardly therefrom for providing at least part of an air flow path between said opening in said ceiling and said venturi, said plenum box having an opening in its top cover for registration with said venturi, and means for securing said venturi to said plenum box from the inside of and from below the plenum box and the venturi.

2. In a ventilating fan as set forth in claim 1 wherein said securing means comprises a plurality of fingers extending generally radially inwardly of said opening in said top cover, said fingers being integral with said top cover and being bendable upwardly to be received on the inside surface of said venturi, and band means installable on the inside of said fingers such that fasteners may be inserted through apertures in said band means, in said fingers, and in said venturi thereby to secure said venturi to said plenum box.

3. In a ventilating fan as set forth in claim 1 wherein said means on the outer end of each of said frame arms engagable with the upper faces of said joists for securely mounting said motor and fan blade to said joists comprises a bracket secured in a predetermined location on said arms and being securable to said joists thereby to secure said frame to said joists.

4. In a ventilating fan as set forth in claim 1 wherein said joists are on a first spaced apart relation relative to one another and wherein said plenum box is so sized as to fit between the inner faces of the adjacent joists and to extend from the bottom faces of the joists to a level proximate the upper faces of said joists.

5. In a ventilating fan as set forth in claim 1 wherein said joists are spaced apart a distance less than the width of the opening cut in said ceiling such that at least one of the joists extends across said opening, said plenum box including means for accommodating said at least one joist whereby with the plenum box inserted through the opening in the ceiling above the level of the joists and with the plenum box being centered on said opening, said joist accommodating means receives said at least one joist thereby to permit the plenum box to be installed on the joists relative to the opening so as to provide at least part of an air flow path between said opening and said venturi.

6. In a ventilating fan as set forth in claim 5 wherein said joists accommodating means comprises prescored flaps provided in the sides of said plenum box which may be opened to accommodate said at least one joist.

7. In a ventilating fan as set forth in claim 1 wherein said plenum box is a preformed flat sheet of rigid material prescored and prefolded to be bent into a boxlike configuration having a pair of opposite major sides and a pair of opposite minor sides.

8. In a ventilating fan as set forth in claim 7 wherein the joists of said ceiling may be any one of a number of heights and wherein said major sides and said minor sides of said plenum box have means thereon for permitting excess material to be trimmed from the lower free ends of the sides of said plenum box so that the bottom edges of the sides of the plenum box are generally in register with the bottom faces of said joists and such that said top cover of said plenum box is generally in register with the top surfaces of said joists.

9. In a ventilating fan as set forth in claim 1 wherein each of said frame arms extends outwardly beyond said venturi, said fan motor and fan assembly being mounted substantially coaxially within said venturi.

10. A ventilating fan as set forth in claim 9 wherein said venturi is secured to said frame, wherein two of said joists extend across openings, and wherein the overall length of said venturi with said fan/motor assembly secured to said frame has an overall length less than the distance between the inner faces of said joists extending across said opening whereby said venturi and fan assembly may be inserted up through said ceiling between said adjacent joists from below.

11. In a ventilating fan as set forth in claim 10 wherein said plenum box has a length and a width such that the plenum box may be inserted up through said opening in said ceiling sheathing from below and fitted to said joists such that the bottom edges of said plenum box are generally coplanar with the bottom surfaces of said joists and such that the top cover of said plenum box is generally coplanar with the upper surfaces of said joists whereby the plenum box constitutes a part of an air flow path between said opening and said venturi.

12. A method of installing a whole house ventilating fan in the ceiling of a house for drawing outside air into the living space of the house, for forcing air from within the living space of the house into the attic space of the house, and for exhausting air from the attic space to the out of doors with the fan being installable in the ceiling from below without the necessity of access to the attic space from above and without the necessity of cutting any ceiling joists, said ceiling comprising a plurality of parallel joists spaced at substantially equal distances from one another, sheathing secured to the bottom faces of said joists, and a generally rectangular opening in said ceiling sheathing having a length and a width, said ventilating fan comprising a generally rectangular plenum box having sides and a top cover, venturi opening in said top cover, said ventilating fan further including a fan and motor assembly including a frame with a venturi mounted to said fan/motor assembly, said frame having a plurality of arms adapted to engage the upper surfaces of at least two adjacent joists, wherein the method comprises the steps of:

inserting said fan/motor assembly with said venturi secured thereto through said ceiling opening from below into the attic space;

installing said motor/fan assembly with said venturi thereon on top of said joists from below with the arms of said frame in engagement with said pair of said joists and with said motor/fan assembly and said venturi substantially centered with respect to said opening in said ceiling;

securing said frame members to said joists;

inserting said plenum box through said opening from below;

securing said plenum box relative to said joists with the bottom edges of said plenum box being generally coplanar with the bottom faces of said joists, with the top cover of said plenum box being generally coplanar with the upper faces of said joists, and with said venturi opening in said top cover being in register with said venturi; and securing said plenum box to said venturi from below and from within said venturi.

* * * * *

UNITED STATES PATENT AND TRADEMARK OFFICE

CERTIFICATE OF CORRECTION

PATENT NO. : 4,501,194

DATED : February 26, 1985

INVENTOR(S) : William J. Brown

It is certified that error appears in the above—identified patent and that said Letters Patent is hereby corrected as shown below:

Column 2, line 32, "4,325,550" should read "4,385,550".

Signed and Sealed this

First Day of October 1985

[SEAL]

*Attest:*

DONALD J. QUIGG

*Attesting Officer*

*Commissioner of Patents and Trademarks—Designate*